US006498852B2

(12) United States Patent
Grimani

(10) Patent No.: US 6,498,852 B2
(45) Date of Patent: Dec. 24, 2002

(54) AUTOMATIC LFE AUDIO SIGNAL DERIVATION SYSTEM

(76) Inventor: Anthony Grimani, 862 Sir Francis Drake Bl., San Anselmo, CA (US) 94960

( * ) Notice: Subject to any disclaimer, the term of this patent is extended or adjusted under 35 U.S.C. 154(b) by 172 days.

(21) Appl. No.: 09/733,234

(22) Filed: Dec. 7, 2000

(65) Prior Publication Data

US 2001/0031054 A1 Oct. 18, 2001

Related U.S. Application Data

(60) Provisional application No. 60/169,450, filed on Dec. 7, 1999.

(51) Int. Cl.[7] ..... H04R 5/00
(52) U.S. Cl. ..... 381/18; 381/98
(58) Field of Search ..... 381/18, 19, 20, 381/21, 22, 23, 98, 104, 107, 120, 80

(56) References Cited

U.S. PATENT DOCUMENTS 5,625,696 A * 4/1997 Fosgate ..... 381/18
5,870,480 A * 2/1999 Griesinger ..... 381/18
6,381,333 B1 * 4/2002 Suzuki ..... 381/18

* cited by examiner

*Primary Examiner*—Minsun Oh Harvey
(74) *Attorney, Agent, or Firm*—Larry D. Johnson; Craig M. Stainbrook; Johnson & Stainbrook, LLP

(57) ABSTRACT

An automatic LFE audio signal derivation processor incorporating signal measurement functions, signal filtering functions, signal limiting/compressing functions, signal gain adjusting functions, and operating indication functions, for use with multichannel soundtracks. Audio input signals are fed to the processor and split for processing in three blocks, including a detector, which analyzes the low frequency content of the incoming signal and controls each of two subsequent blocks, a variable low frequency shelving network in which the amount of low frequency attenuation is variable and which responds to a control signal from the detector, and a variable gain amplifier in which the gain responds to the control signal from the detector circuit.

11 Claims, 7 Drawing Sheets

AUTOMATIC LFE AUDIO SIGNAL DERIVATION SYSTEM

CROSS-REFERENCE TO RELATED APPLICATIONS

This application for United States Letters Patent claims the benefit of the filing date of U.S. Provisional Patent Application No. 60/169,450, filed Dec. 7, 1999.

BACKGROUND OF THE INVENTION

1. Field of the Invention

The present invention relates generally to systems for producing the soundtrack content for a low-frequency-only channel in a multichannel soundtrack, and more particularly to a method and apparatus for deriving or creating an audio Low Frequency Effect (LFE) signal in 5.1, 6.1, and 7.1 channel sound tracks and musical recordings. The present invention would also relate to systems with more than one low-frequency-only channels 2. Discussion of Related Art When a multichannel film soundtrack, television program soundtrack, or a musical recording is produced, it is most often done so in a 5.1 channel format. These include five full frequency range channels located respectively in the Front Left, Front Center, Front Right, Surround Right and Surround Left locations of the auditorium or listening room, along with a "0.1" low-frequency-only channel generally located along the front of the room. The "0.1" channel can be arranged in an electroacoustic dynamic range so as to produce 10 dB higher sound pressure than that of the five main channels for the same modulation of the recording medium.

Using existing technologies, producing the soundtrack content for the 0.1 LFE channel is often a cumbersome and misunderstood process. The LFE channel should theoretically only be used once the low frequency output capabilities of the main channels have been exceeded and the sound recordist would nevertheless desire more low frequency sound pressure level. To achieve the desired effect recordists occasionally send the same signal that is overloading the main channels into the LFE. However, often a different signal is sent to the LFE, and this results in incompatibilities when the soundtrack is played back in 5.1-to-2 channel downmixed mode over a 2 channel playback system. This will happen most often when a multichannel film, television, or music sound recording is reproduced in an end user's home equipped with standard 2 channel stereo audio system. Standard 2 channel stereo audio systems represent the vast majority of residential sound systems, and compatibility issues must therefore be resolved for proper interchange between production and reproduction spaces. Note that the 2 channel downmix signal is also used by the consumer with a Dolby ProLogic surround decoder, where the downmix would have been done with Dolby Surround Matrix encoding.

What is needed is a means to automatically detect the conditions for main channel overload, and a means for subsequently assigning the overload portion of the signal to the LFE channel.

SUMMARY OF THE INVENTION

The Automatic LFE Audio Signal Derivation System of the present invention is well suited for 5.1, 6.1, and 7.1 channel use. For 5.1 channel use, a signal processing device with six audio inputs and six audio outputs would be used to accomplish automatic LFE derivation, said signal processing device incorporating signal measurement functions, signal filtering functions, signal limiting/compressing functions, signal gain adjusting functions, and operating indication functions. Systems for 6.1 and 7.1 channel use would be similar, with the addition of Main channels to the processor.

In operation each main signal fed to the processor is split and processed in three blocks, including a detector, which analyzes the low frequency content of the incoming signal and controls each of two subsequent blocks, including a Variable Shelving Network "VSN" block and a Variable Gain Amplifier "VGA" block. The VSN is a variable low frequency shelving network in which the amount of low frequency attenuation is variable and which responds to a control signal from the detector circuit. The VGA is a variable gain circuit in which the gain responds to the control signal from the detector circuit. As an incoming signal low frequency level exceeds a threshold programmed into the detector circuit, the VSN attenuates low frequencies and the VGA gain increases from 0X and feeds signals into summing networks leading to a Low Frequency Effect output. With increasing level beyond the above-stated threshold level, the VSN attenuates more low frequency in the main signal output and the VGA feeds more signal into the LFE output. The LFE output is preceded by a Low Pass filter, which has a frequency characteristic matching that of the shelving networks in the VSN. Wherever applicable, the overall Low frequency level is maintained in the listening room by attenuating the overall VGA feeds by 10 dB to compensate for the 10 dB gain in electro-acoustic level of the LFE channel in 5.1, 6.1, and 7.1 sound systems.

Several practical variations on the design of the Variable Shelving Network are set out in the Detailed Description below.

DETAILED DESCRIPTION OF A PREFERRED EMBODIMENT

Figure 1:
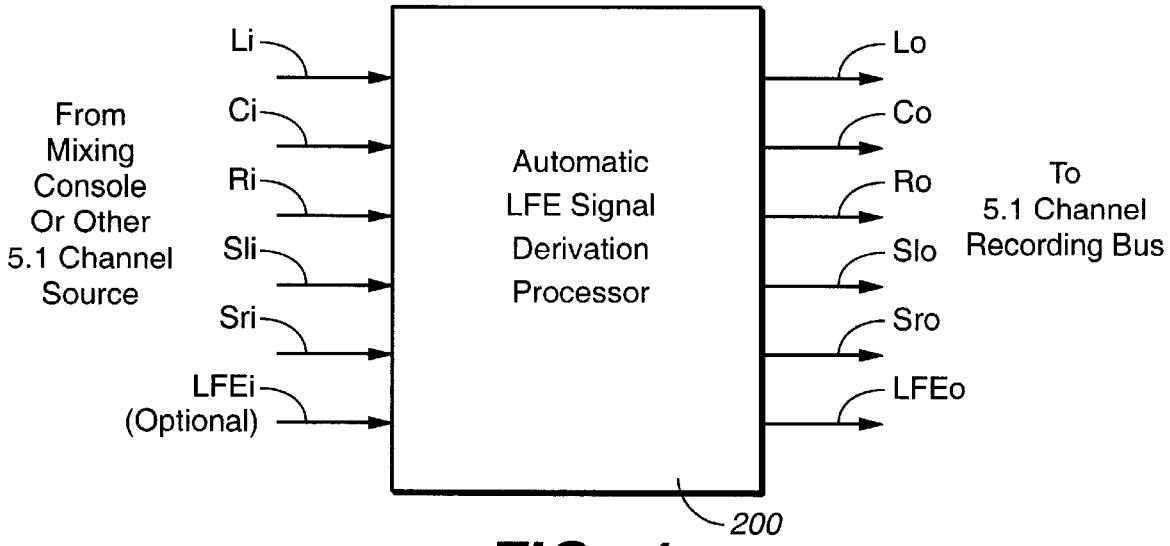
FIG. 1 is a block diagram depicting the Automatic LFE Audio Signal Derivation System of the present invention having six audio inputs and outputs corresponding to left, center, right, surround left, surround right, and an optional low frequency only channel.

FIG. 1 is a block diagram depicting the Automatic LFE Audio Signal Derivation System 200 of the present invention having six audio inputs—left input Li, center input Ci, right input Ri, surround left input Sli, surround right input Sri, and an optional LFE input LFEi—and corresponding outputs, Lo, Co, Ro, Slo, Sro, and LFEo, respectively, corresponding to left, center, right, surround left, surround right, and low frequency only channels. As depicted in this figure, for 5.1 channel use, a signal processing device with six audio inputs and six audio outputs would be used to accomplish automatic LFE derivation. This signal processing device would incorporate signal measurement functions, signal filtering functions, signal limiting/compressing functions, signal gain adjusting functions, and operating indication functions.

Figure 2:
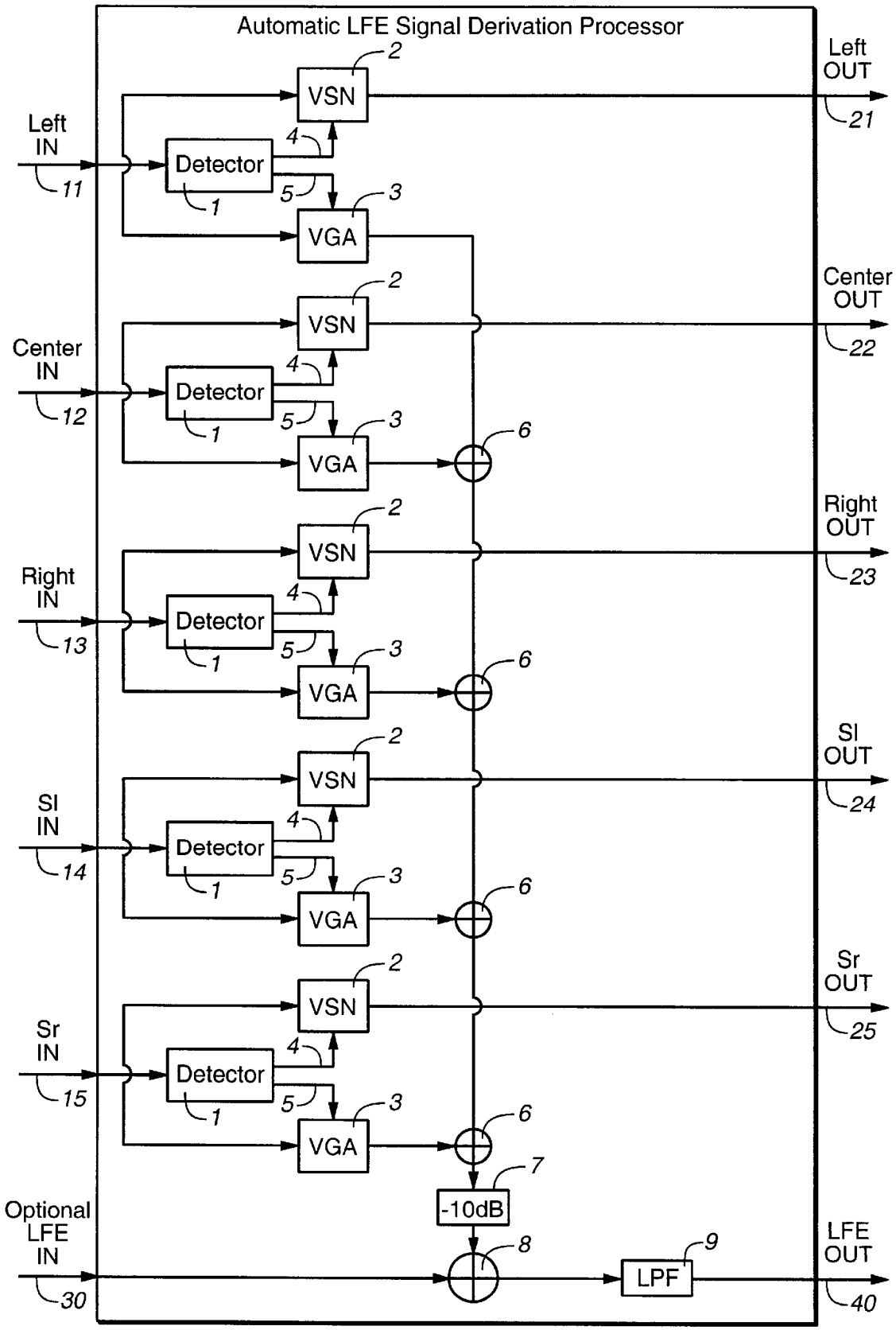
FIG. 2 is a block diagram of the first preferred embodiment of the Automatic LFE Signal Derivation Processor of FIG. 1.

FIG. 2 shows an internal block diagram of the Automatic LFE Signal Derivation Processor for a 5.1 channel system. Systems for 6.1 and 7.1 channel use would be similar, with the addition of Main channels to the processor, expanding the number of inputs and outputs. Also, recording formats with multiple LFE channels would be similar, with the addition of low frequency input and outputs. Each "Main" signal, 11 through 15, fed to the processor is split and processed in three blocks: Block One comprises a Detector 1, which analyzes the low frequency content of the incoming signal and controls both Block Two, the VSN 2, and Block Three, the VGA 3 (Variable Gain Amplifier). VSN 2 is a variable low frequency shelving network in which the amount of low frequency attenuation is variable and which responds to a first control signal 4 from the Detector circuit. Block Three, the VGA is a variable gain circuit in which the gain responds to a second control signal 5 from the Detector circuit. When the low frequency level of an incoming signal exceeds a threshold programmed into the Detector circuit, the VSN begins to attenuate low frequencies and the VGA gain increases from 0X and starts to feed signals into the Summing networks 6 leading to the LFE Output 40. As low frequency levels increase level beyond the threshold level, the VSN attenuates more low frequency in the main signal output and the VGA feeds more signal into the LFE output. The LFE output is preceded by a low pass filter 9, which has a frequency characteristic matching that of the shelving networks in the VSN. The overall low frequency level may be maintained in the listening room by attenuating the overall VGA feeds by 10 dB with optional/selectable attenuator 7, to compensate for the 10 dB gain offset in electro-acoustic level of the LFE channel in 5.1, 6.1, and 7.1 sound systems. It should be noted that low pass filter 9 could be located prior to attenuator 7 without compromising the processor output.

As may be readily appreciated by those knowledgeable in the relevant art, the foregoing description of the present invention and the corresponding figures are generally directed to analog domain signal flow. However, in each instance, functionally equivalent digital processes emulating the analog process are expressly contemplated and included in the present invention. Accordingly, for example, the digital processing equivalent of the VGA is a Multiplier, or variable gain cell, and all references herein to an analog VGA include its digital counterpart. The digital processing equivalent of the VSN is a variable frequency shelving network, and all references herein to an analog also VSN include its digital counterpart.

Figure 3:
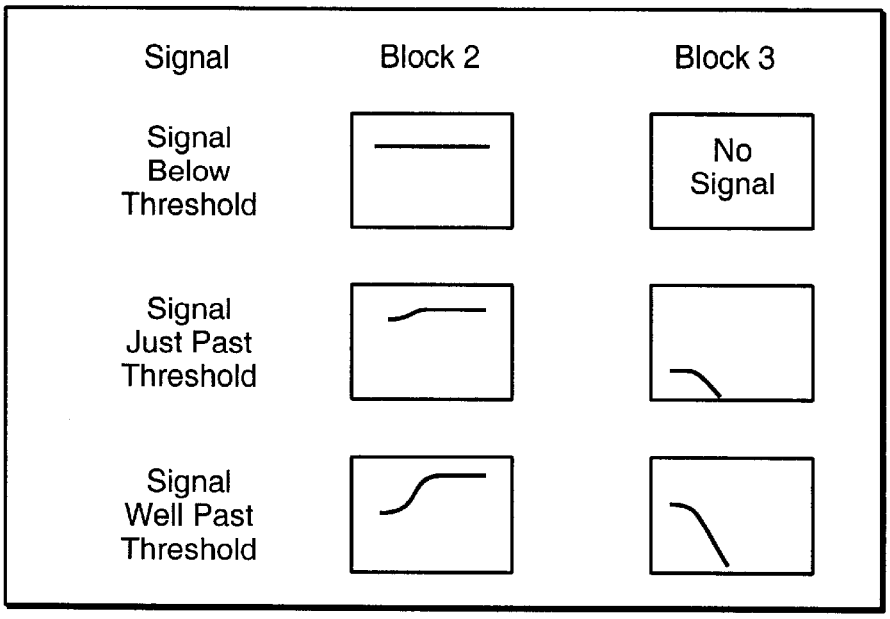
FIG. 3 is graphic depiction of the relationship of the signals at the output of the VSN (Variable Shelving Network) and the VGA (Variable Gain Amplifier) of the processor of FIG. 2.
Figure 4:
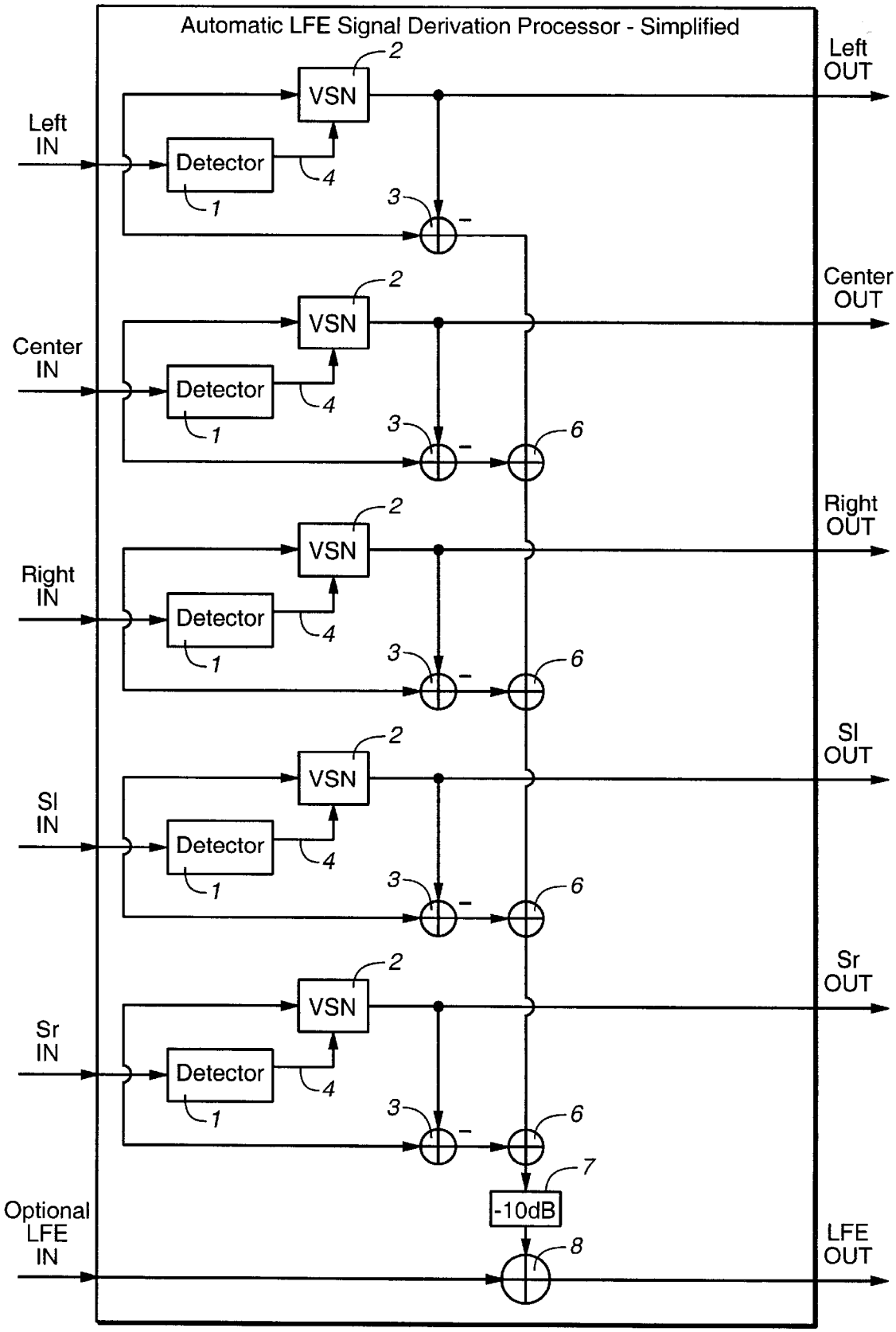
FIG. 4 is a block diagram of a second preferred embodiment of the Automatic LFE Signal Derivation Processor of FIG. 1.

FIG. 3 shows the relationships between the signals at the output of the VSN and the VGA, Blocks Two and Three, respectively. The VSN/VGA combination can be simplified by use of a differentiating network. FIG. 4 outlines this simpler scheme.

As shown in FIG. 4, a second embodiment of the processor of the present invention, the detector and the VSN, and control signal 4 are all identical to those in the earlier design of FIG. 2. However, in this embodiment, rather than having a VGA, this embodiment includes a subtractive network 3 where the low frequency attenuated signal at the output of VSN 2 is subtracted from the original incoming signal. The resulting signal at the output of subtractive network 3 is a low frequency only signal with increasing level as the attenuation of the VSN increases. This circuit removes the need for five VGA's, which are inherently expensive networks. Since the signal at the output of the VGA is inherently low frequency only, there is no need for the Low Pass Filter 9 originally in FIG. 2.

Figure 5:
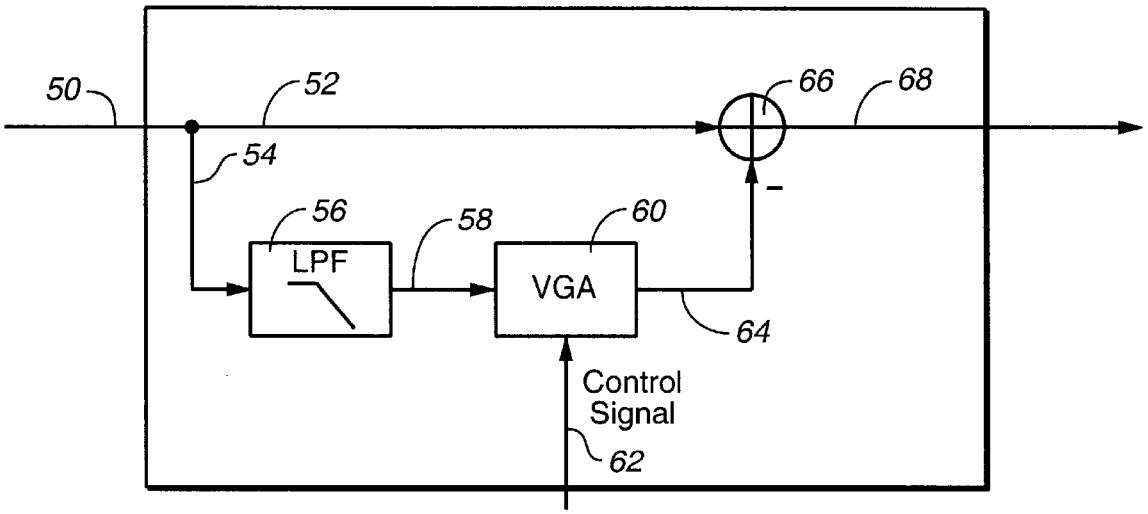
FIG. 5 shows one possible design for the Variable Shelving Network of the processor of FIGS. 2 and 4.

There are several design approaches for the Variable Shelving Network. FIG. 5 shows one approach. In FIG. 5 the input signal 50 is split into a main path 52 and a side chain 54. The side chain 54 contains a Low Pass Filter (LPF) 56 with corner frequency and order selected appropriately for the LFE channel bandwidth, typically 80 Hz, $2^{nd}$ or $4^{th}$ order. The LPF output 58 is gain controlled through a VGA 60 which receives its control signal 62 (corresponding to reference numeral 2 in FIGS. 2 and 4, supra) from the Detector. The gain of the VGA is to increase from 0 to 1 as the input signal reaches and passes beyond the threshold level. The VGA output 64 is inverted and summed at summing network 66 to the main path signal. The resultant signal 68 is a low frequency downward shelved signal. For signal quality purposes in actual application it might be beneficial to place the VGA before the LPF to benefit from the reduced noise spectrum at the output of the LPF. Also the phase response of the subtractive signal needs attention or compensation so as to ensure the right frequency response around the cutoff region. Alternatively the Side Chain 54 can be set up in a feedback form where its output sums with the main path ahead of signal splitting node.

Figure 6:
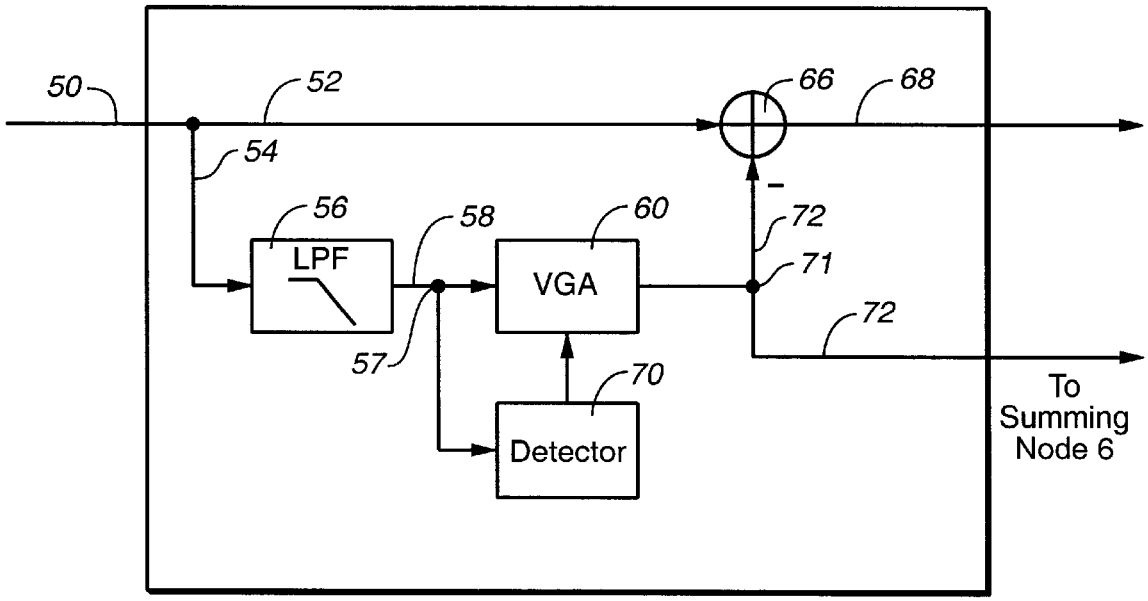
FIG. 6 illustrates an alternative design for the Variable Shelving Network wherein the VGA is controlled by a detector circuit with wideband sensitivity placed after the Low Pass Filter.

An advantage of the design in FIG. 5 is that the signal at the output of the VGA can also be used as the signal fed to the LFE summing networks 6 in FIG. 4, thereby further simplifying the design topology and processing algorithm. As shown in FIG. 6, another advantage of this design is that the VGA 60 can be controlled by a detector circuit 70 with wideband sensitivity, but placed after the LPF block 56, thereby reducing the complexity of the detector circuit 1 of FIGS. 2 and 4. In this configuration, the VGA output 72 creates a feed to the LFE output and is also inverted and summed at summing network 66 with the main path signal 52 to create a resultant low frequency downward shelved signal 68.

Figure 7:
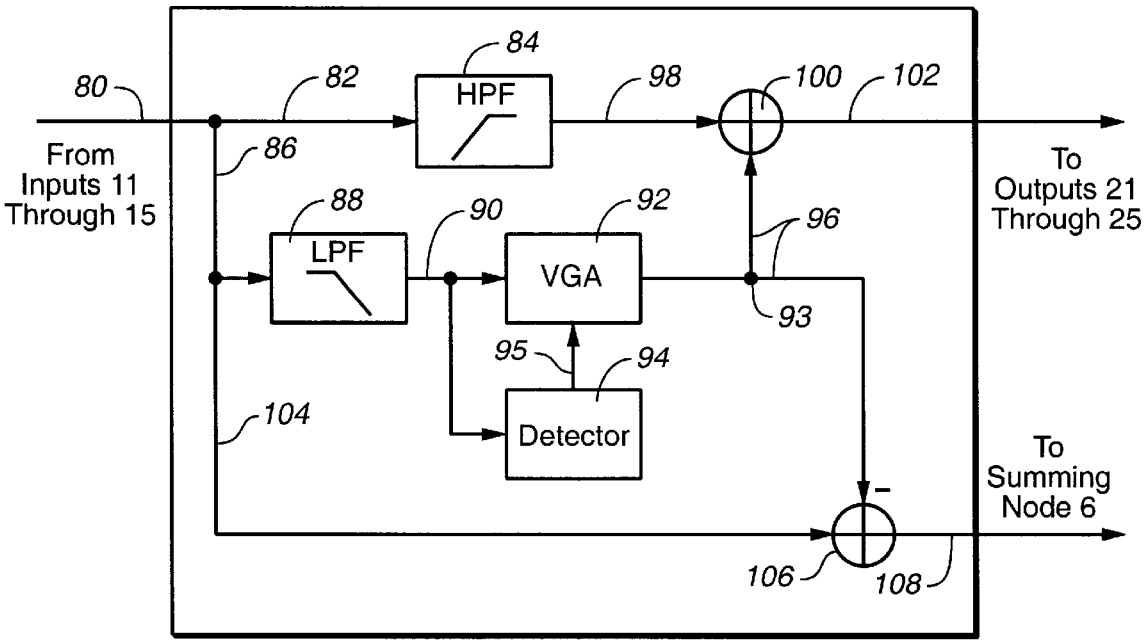
FIG. 7 illustrates a practical design that combines parts of the designs of FIGS. 5 and 6.

A practical design using off-the-shelf limiter VGA circuits can be achieved by combining parts of the solutions shown above. FIG. 7 shows this design. In FIG. 7 the Input signal 80 is split three ways. A first path 82 goes through a High Pass Filter (HPF) 84, typically a $4^{th}$ order double Butterworth, with 180° phase shift and −6 dB at the roll-off frequency. The second path 86 goes through a Low Pass Filter (LPF) 88 with the same characteristics as the HPF above. The output 90 of the LPF goes to a VGA 92 and Detector 94 pair set-up for threshold-based signal limiting. Detector 94 provides a control signal 95 to VGA 92. The VGA output 96 sums with the HPF output 98 at summing network 100 and full bandwidth signal 102 is recovered.

When an input signal is below the threshold level, the VGA gain is 1 and the summation of the two paths leads to flat frequency response. When a signal at the input exceeds the threshold level, the VGA gain reduces and the Output signals contain less low frequency signal than high frequency signals. The more the Input signal exceeds the threshold the more attenuation is provided by the VGA block, and the lower the level of low frequencies.

The third path 104 in FIG. 7 has the output of the VGA subtracted from it at network 106, thereby creating a feed 108 to the LFE Output. As an input signal exceeds the threshold level, the low frequency content of the signal to the summing nodes (denominated by reference numeral 6 in FIGS. 2 and 4) increases. At the output 108 of the block in FIG. 7 the third path has a high pass character, and it will need a low pass filter (such as LPF 9 of FIG. 8) to compensate it.

Figure 8:
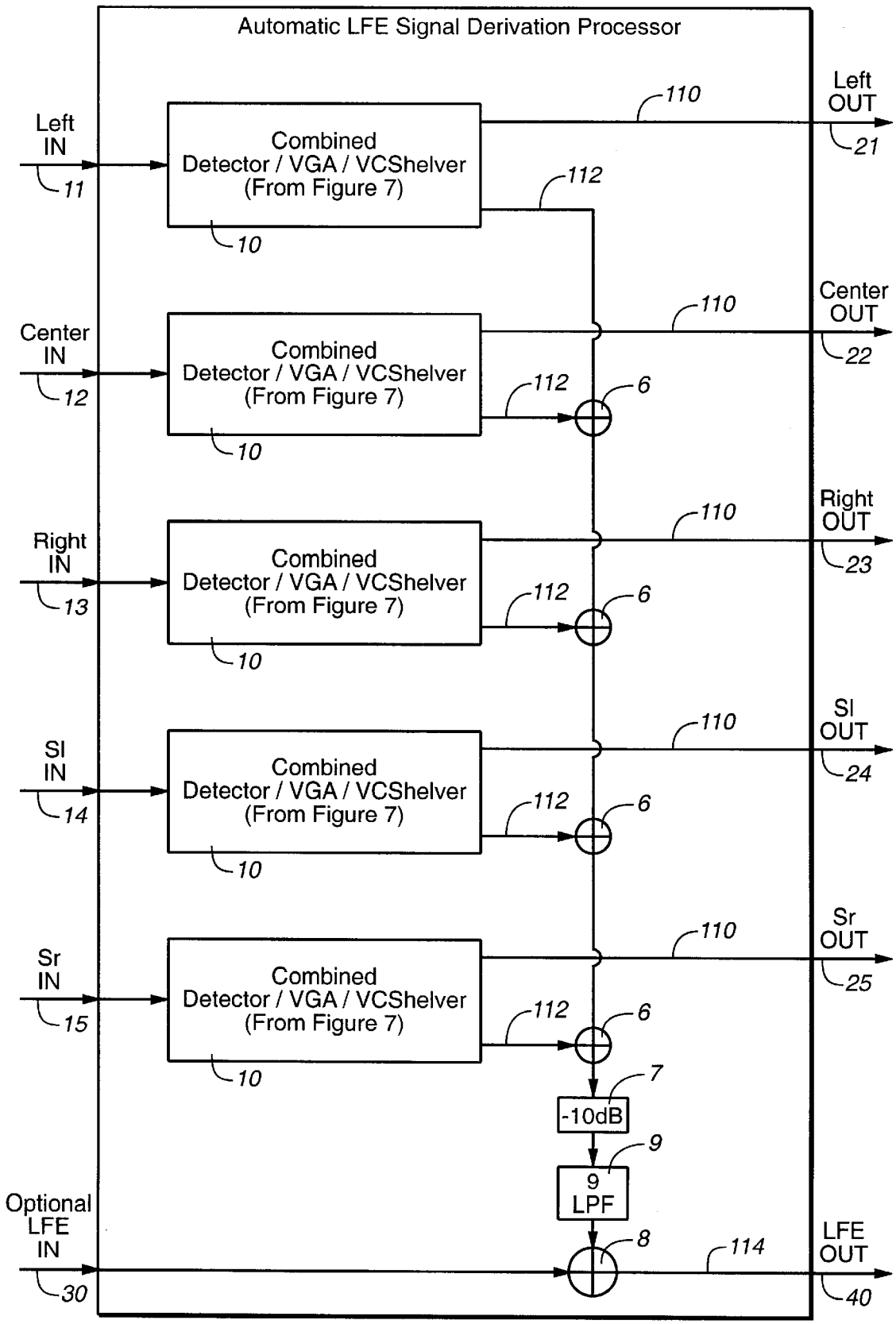
FIG. 8 shows a complete processor utilizing the combined circuit of FIG. 7.

FIG. 8 shows a complete Processor utilizing the combined circuit of FIG. 7. Each Main channel signal, 11 through 15, is fed to a combined processor 10. One output 110 of each of the processors 10 goes to a main output, one of 21 through 25, corresponding to the respective processor. The other output signal 112 of processors 10 feeds the summing networks 6, the optional/selectable 10 dB attenuator 7, the Low Pass Filter 9, and the LFE summing network 8. The output 114 of LFE summing network 8 is fed to the LFE output 40.

Figure 9:
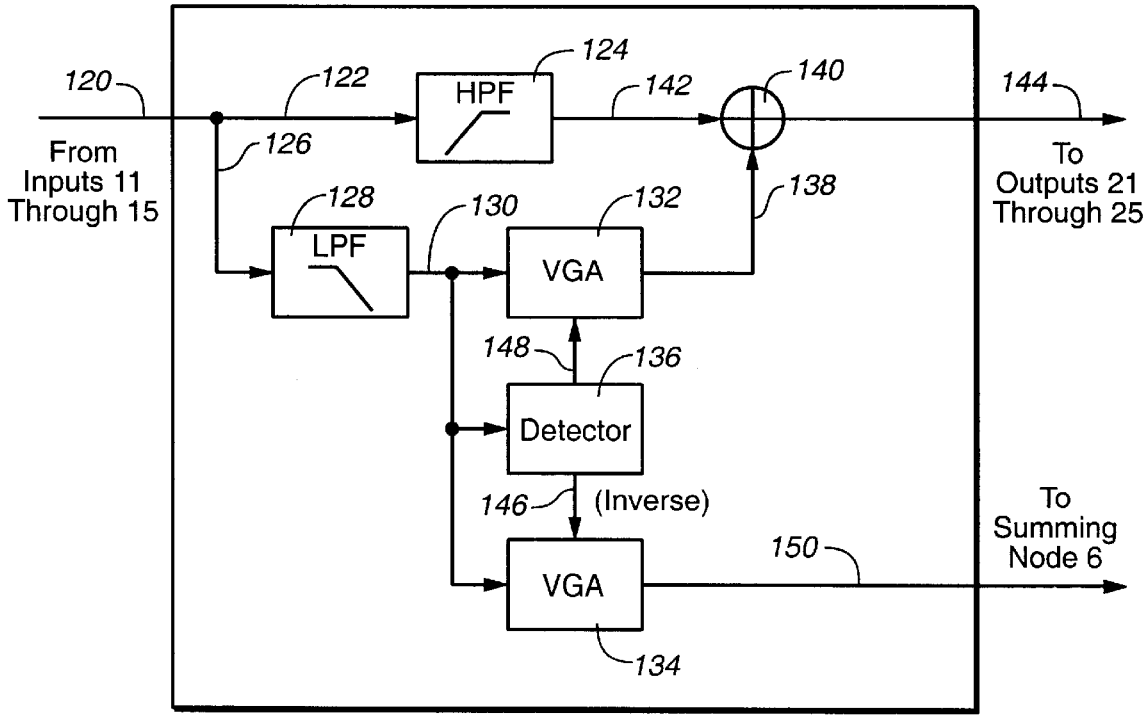
FIG. 9 illustrates a practical design using off-the-shelf limiter VGA circuits that combines various features of the solutions shown in FIGS. 2 through 7.

Another practical design using off-the-shelf limiter VGA circuits can be achieved by combining parts of the solutions shown above. FIG. 9 illustrates such a design. In FIG. 9 the Input signal 120 is split two ways. A first path 122 goes through a High Pass Filter (HPF) 124, typically a $4^{th}$ order double Butterworth, with 180° phase shift and −6 dB at the roll-off frequency. The second path 126 goes through a Low Pass Filter (LPF) 128 with the same characteristics as the HPF above. The output 130 of the LPF goes to two VGAs (a first VGA 132 and a second VGA 134) and a Detector system 136 set-up for threshold-based signal limiting actuation. The first VGA output 138 sums at summing network 140 with the HPF output 142 and full bandwidth signal 144 is recovered. When an input signal is below the threshold level, the first VGA 132 gain is 1 and the summation of the two paths leads to flat frequency response. When a signal at the input exceeds the threshold level, the VGA 132 gain reduces and the Output signals 138 contain less low frequency signal than high frequency signals. The more the Input signal exceeds the threshold the more attenuation is provided by the first VGA block 132, and the lower the level of low frequencies.

The second VGA 134 in FIG. 9 receives the output 130 from the Low Pass Filter (LPF) 128 and is gain-controlled by a signal 146 from the Detector system that has an inverse characteristic as compared to the signal 148 that controls first VGA 132. When the signal through first VGA 132 attenuates, the signal through second VGA 134 increases in amplitude from no signal to full level. The output 150 from second VGA 134 feeds low frequency signals to the LFE Output. As an input signal exceeds the threshold level, the low frequency content of the signal to the summing nodes 6 increases.

Figure 10:
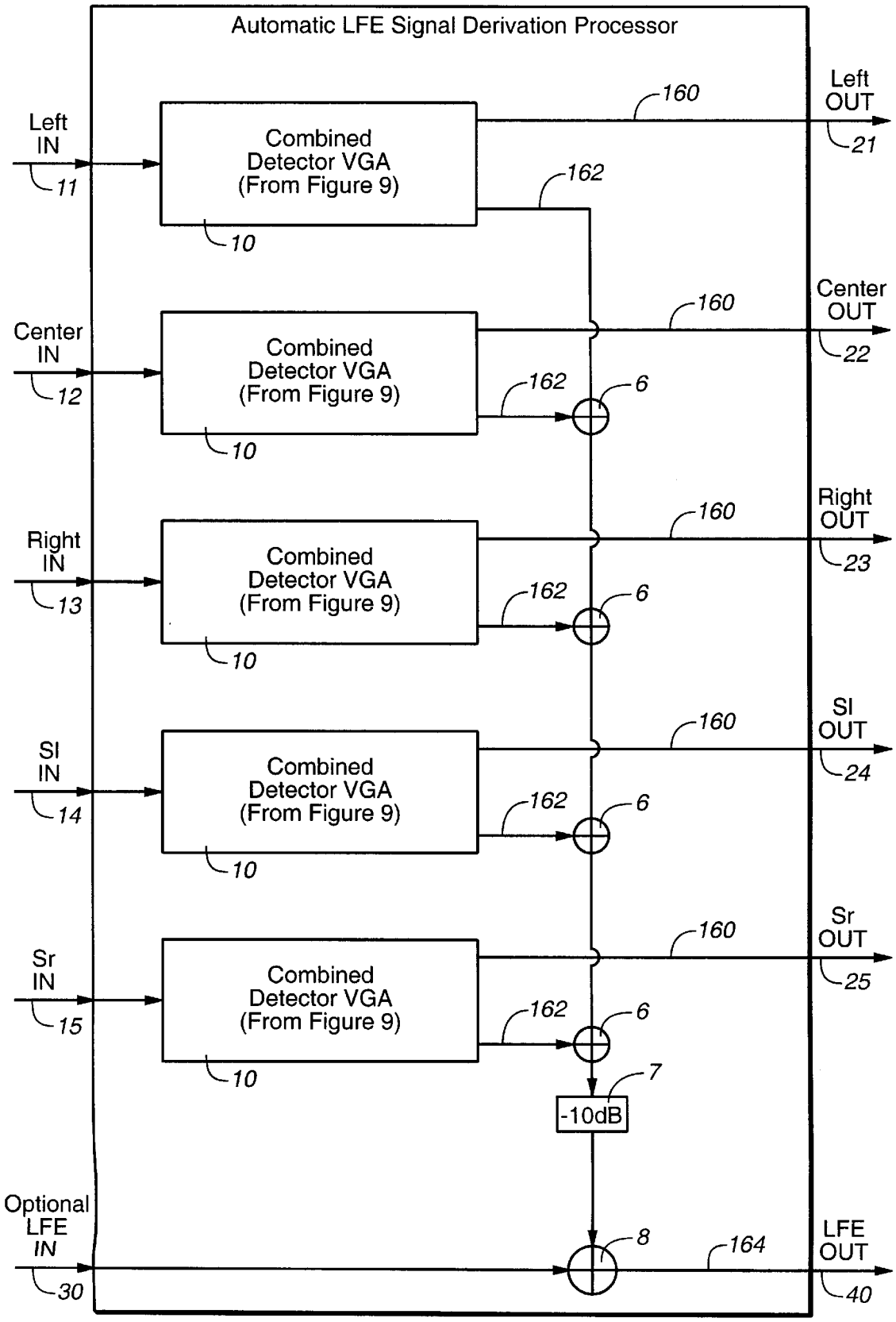
FIG. 10 shows a complete processor utilizing the combined circuit of FIG. 9.

FIG. 10 shows a complete Automatic LFE Signal Derivation Processor utilizing the combined circuit of FIG. 9. Each Main channel signal, 11 through 15, is fed to a combined processor 10. A first output 160 of processors 10 goes to the Main outputs 21 through 25. The second signal 162 out of processors 10 feeds the summing networks 6, the selectable 10 dB attenuator 7, and the LFE summing network 8. The output 164 of summing network 8 is fed to the LFE output 40. Although not the simplest possible topology, an analog signal processing version of this processor may be built using standard off-the-shelf parts and at reasonable costs.

While this invention has been described in connection with preferred embodiments thereof, it is obvious that modifications and changes therein may be made by those skilled in the art to which it pertains without departing from the spirit and scope of the invention. Accordingly, the scope of this invention is to be limited only by the appended claims.

What is claimed as invention is:

1. A signal derivation processor for automatically deriving an audio LFE signal in multichannel soundtracks, said processor comprising:

a plurality of main audio input channels;

a plurality of audio output channels, one each corresponding to each of said main audio input channels;

a low frequency effect output channel;

a detector for one of each of said main audio input channels, said detector having programmable low frequency thresholds, said detector for analyzing the low frequency content of the incoming main channel signal and having at least one detector output signal;

a variable shelving network for one of each of said main audio input channels for variable low frequency attenuation of the input signal when said programmable low frequency threshold of the signal is exceeded, said variable shelving network having an output signal;

at least one variable gain amplifier for amplifying the input signal when said programmable low frequency threshold is exceeded, said variable gain amplifier under the control of said at least one detector output signal, said variable gain amplifier having an output signal; and a plurality of summing networks in series, said plurality being one less in number to the number of main channels, said summing networks summing the output signals of said variable gain amplifiers and having a signal to an LFE summing network, said LFE summing network feeding said low frequency effect output signal.

2. The signal derivation processor of claim 1 further including a low frequency only audio input channel, said low frequency only audio input channel feeding said Low Frequency Effect summing network.

3. The signal derivation processor of claim 1 further including an attenuator interposed between said low frequency effect summing network and the summing network immediately preceding said low frequency effect summing network, said attenuator for attenuating the overall, summed VGA output signal to compensate for a 10 dB gain of the LFE channel in multichannel sound systems.

4. The signal derivation processor of claim 1 wherein said variable shelving network is controlled by at least one of said detector output signals.

5. The signal derivation processor of claim 1 wherein when the low frequency level of any of said main channel incoming signals exceeds a threshold programmed into said detector, said variable shelving network attenuates low frequencies and said variable gain amplifier gain increases from 0X and feeds signals into said summing networks leading to said LFE output signal, and wherein as low frequency levels increase beyond the programmed detector threshold, said variable shelving network attenuates more low frequency in the main signal output and said variable gain amplifier feeds more signal into said LFE output signal.

6. The signal derivation processor of claim 1 further including a low pass filter interposed between said LFE output signal and the summing network immediately preceding said LFE summing network.

7. The signal derivation processor of claim 1 further including a low pass filter interposed between said LFE output signal and said LFE summing network.

8. A signal derivation processor for automatically deriving an audio LFE signal in multichannel soundtracks, said processor comprising:

a plurality of main audio input channels;

a plurality of audio output channels, one each corresponding to each of said main audio input channels;

a low frequency effect output channel;

a detector for one of each of said main audio input channels, said detector having programmable low frequency thresholds, said detector for analyzing the low frequency content of the incoming main channel signal and having at least one detector output signal;

a processing block for processing one of each of said main audio input channels, said processing block comprising a main signal path and a side signal path and having a low pass filter and a variable gain amplifier in electronic communication to produce a low frequency downward shelved output signal from said processing block; and a plurality of summing networks in series, said plurality being one less in number to the number of main channels, said summing networks summing the low frequency downward shelved signals of said processing blocks, said summing networks having a signal to an LFE summing network, said LFE summing network feeding said Low Frequency Effect output signal.

9. The signal derivation processor of claim 8 wherein said low pass filter precedes said variable gain amplifier in said side signal path and has an output signal controlled through said variable gain amplifier, said variable gain amplifier under the control of one of at least one detector output signals, said variable gain amplifier having an output signal which is inverted and summed with the signal of said main signal path to produce said low frequency downward shelved signal.

10. A signal derivation processor for automatically deriving an audio LFE signal in multichannel soundtracks, said processor comprising:

a plurality of main audio input channels;

a plurality of audio output channels, one each corresponding to each of said main audio input channels;

a low frequency effect output channel;

a processing block for processing one of each of said main audio input channels, said processing block comprising a main signal path and a side signal path, said main signal path having a high pass filter with an output signal, said side signal path having a detector with programmable low frequency thresholds, said detector for analyzing the low frequency content of the side path signal and having two detector output signals, said processing block further having a low pass filter and two variable gain amplifiers, said low pass filter preceding said variable gain amplifiers and said detector on said side signal path, wherein each of said variable gain amplifiers is controlled by one of said two detector output signals, one of said variable gain amplifiers having a first processing output signal, the other of said variable gain amplifiers having an output signal which is summed with said output signal of said high pass filter to produce a second processing output signal corresponding to one of said main audio outputs; and a plurality of summing networks in series, said plurality being one less in number to the number of main channels, said summing networks summing said first processing output signals, said summing networks having a signal to an LFE summing network, said LFE summing network feeding said Low Frequency Effect output signal.

11. The signal derivation processor of any one of claims 1 through 10, inclusive, wherein said variable gain amplifier is a digital signal processing variable gain cell, and wherein said variable shelving network is a digital signal processing variable frequency shelving network.

* * * * *